US005724830A

United States Patent [19]

Otis et al.

[11] Patent Number: 5,724,830

[45] Date of Patent: Mar. 10, 1998

[54] FLUID INDUCTION AND HEAT EXCHANGE DEVICE

[76] Inventors: Michael Tracy Otis, 16827-B Alamosa, Fountain Hills, Ariz. 85268; Mark Stephen Shepherd, 6723 Plymouth Rd. #7, Stockton, Calif. 95207-2327

[21] Appl. No.: 684,503

[22] Filed: Jul. 19, 1996

Related U.S. Application Data

[60] Provisional application No. 60/001,250 Jul. 19, 1995.

[51] Int. Cl.[6] ..... F25B 39/04

[52] U.S. Cl. ..... 62/509; 62/507; 165/109.1

[58] Field of Search ..... 62/503, 527, 83, 62/471, 470, 473, 512, 509, 511, 513, 507, 506; 165/109.1

[56] References Cited

U.S. PATENT DOCUMENTS

| | | | |
|---|---|---|---|
| 3,171,476 | 3/1965 | Laurito | 165/109.1 X |
| 3,232,341 | 2/1966 | Woodworth | 165/109.1 |
| 3,796,064 | 3/1974 | Ladusaw | 62/503 |
| 4,139,990 | 2/1979 | Barnes . | |
| 4,194,370 | 3/1980 | Morse | 62/503 |
| 4,651,540 | 3/1987 | Morse . | |
| 4,694,662 | 9/1987 | Adams | 62/509 |
| 4,827,725 | 5/1989 | Morse . | |
| 5,058,395 | 10/1991 | Ni et al. | 62/83 X |
| 5,282,370 | 2/1994 | Kiblawi . | |
| 5,331,827 | 7/1994 | Chlebak | 62/509 |
| 5,334,239 | 8/1994 | Choe . | |
| 5,426,956 | 6/1995 | Phillippe . | |

FOREIGN PATENT DOCUMENTS

| | | |
|---|---|---|
| 4-8580 | 1/1992 | Japan . |
| 5-96325(A) | 8/1993 | Japan . |

*Primary Examiner*—Harry B. Tanner

*Attorney, Agent, or Firm*—Harry M. Weiss; Jeffrey D. Moy; Harry M. Weiss & Associates, P.C.

[57] ABSTRACT

A device for increasing heat transfer and reducing suspended vapor within a fluid. The inventive device includes a main body having at least one pair of conduits positionable into communication with a fluid or refrigerant line. A radial diffuser effects plating or coating of fluid entering the main body onto the interior walls thereof to increase heat transfer. A radial infuser receives collected fluid and directs the fluid into a containment chamber within the main body. A rotational turbulence inducer agitates the fluid as it exits the main body for increasing heat transfer between the fluid and the conduit. Alternative forms of the invention include a turbine mounted within the containment chamber for extracting rotational torque from movement of fluid through the device, and a lower main body having a pair of selectively valved radial infusers permitting reverse flow through the device.

23 Claims, 6 Drawing Sheets

FLUID INDUCTION AND HEAT EXCHANGE DEVICE

RELATED APPLICATION

The present application claims the benefit under Title 35, United States Code, Section 120 of pending United States Provisional application Ser. No. 60/001,250, filed Jul. 19, 1995.

BACKGROUND OF THE INVENTION

1. Field of the Invention

The present invention relates to heat exchangers and more particularly pertains to a fluid induction and heat exchange device for increasing heat transfer and reducing suspended vapor within a fluid such as a refrigerant.

2. Description of the Prior Art

Refrigeration systems utilizing standard refrigerant or heat recycling technologies are conventionally known and include refrigeration, air conditioning, chillers, and heat pump devices. Typically these systems or devices include gases or liquids which are compressed, expanded, heated, and/or cooled within a generally closed system so as to produce temperature gradients. Significant effort has been expended in developing structures which will increase the efficiency of known refrigeration cycles.

In a typical refrigeration system, for example, sub-coolers have been employed to partially cool the refrigerant prior to the expansion device and subsequent evaporator. Such refrigerant cooling has been shown to increase the efficiency of the heat transfer within the evaporator. Various types of sub-coolers exist, but the most common form operates to cool the refrigerant by drawings in cooler liquid to surround the warmer refrigerant.

Another conventionally known method of increasing the efficiency of heat exchange within a refrigeration cycle includes the introduction of turbulent flow to the liquefied refrigerant. The turbulent flow of the refrigerant reduces the boundary layer formed along interior surfaces of the tubing or heat exchanger, thereby providing improved heat exchange between the refrigerant and the tubing or heat exchanger to increase overall system efficiency.

A known prior art means for agitating refrigerant to enhance heat transfer relative thereto is and has been in pubic use in the United States, and elsewhere, since at least about 1992. This known prior art means is the subject of a recently issued U.S. Pat. No. 5,426,956 which issued Jun. 27, 1995 (from U.S. Ser. No. 08/148,008, filed Nov. 4, 1993) to Gary E. Phillippe for a "A Refrigerant System Efficiency Amplifying Apparatus". Phillippe teaches use of a vessel-like device positionable into fluid communication with a refrigerant line. The Phillippe vessel-like device includes an angled inlet conduit designed to create turbulent motion when fluid from the inlet line enters the vessel. During typical operation of the Phillippe device, the fluid entering the vessel impacts liquid residing within the vessel to cause a splash or agitation. Unfortunately this splash or agitation can contaminate the entering fluid with suspended vapor. Also, the Phillippe device does not direct entering fluid radially outwardly against interior surfaces of the vessel to enhance any heat transfer therefrom, but rather directs the entering fluid to the central portion of the vessel. The Phillippe device includes an exit conduit. Fluid exiting from the exit conduit of the vessel device develops a vapor vortex which further draws gas and vapor into the exiting fluid for suspension therein. The Phillippe device does not include structure for limiting the formation of a vapor vortex within the exiting fluid. The Phillippe device may, however, additionally include a disk-like component which is referred to as a "turbulator". The turbulator is positioned in the exiting conduit; it serves to further agitate fluid exiting from the vessel. The "turbulator" of the Phillippe device is a specifically defined disk with two symmetrical flat ramps or blades projecting radially inwardly from diametrically opposed sides of the disk which simply project into the fluid stream and agitate fluid exiting from the vessel.

Another loss of system efficiency unknown in the prior art has been discovered by the named inventors of the present utility patent application. The discovered loss of efficiency results from a quantity of refrigerant which is not completely liquefied within a fluid line. Such a lack of complete liquification of refrigerant within the fluid line creates a layer or void of insulating vapor or gas which decreases heat transfer relative to the refrigerant.

SUMMARY OF THE INVENTION

Accordingly, it is a primary object of the present invention to provide a fluid induction and heat exchange device which induces coating or plating of fluid along interior surfaces thereof so as to enhance heat transfer relative to a fluid or refrigerant traveling through the device.

It is another object of the present invention to provide a fluid induction and heat exchange device which consolidates the fluid without forming a vortex therein prior to exiting of fluid from the device.

It is a further object of the present invention to provide a fluid induction and heat exchange device which introduces turbulent flow to the liquid or refrigerant exiting the device.

It is an even further object of the present invention to provide a new fluid induction and heat exchange device apparatus and method which has many of the advantages of the heat exchangers mentioned heretofore and many novel features that result in a fluid induction and heat exchange device which is not anticipated, rendered obvious, suggested, or even implied by any of the prior art heat exchangers, either alone or in any combination thereof.

It is another object of the present invention to provide a new fluid induction and heat exchange device which may be easily and efficiently manufactured and marketed.

It is yet another object of the present invention to provide a new fluid induction and heat exchange device which is of a durable and reliable construction.

An even further object of the present invention is to provide a new fluid induction and heat exchange device which is susceptible of a low cost of manufacture with regard to both materials and labor, and which accordingly is then susceptible of low prices of sale to the consuming public, thereby making such fluid induction and heat exchange devices economically available to the buying public.

Still yet another object of the present invention is to provide a new fluid induction and heat exchange device which provides in the apparatuses and methods of the prior art some of the advantages thereof, while simultaneously overcoming some of the disadvantages normally associated therewith.

To attain this, the present invention generally comprises a device for increasing heat transfer and reducing suspended vapor within a fluid. The inventive device includes a main body having one or more pairs of conduits positionable into communication with a fluid or refrigerant line. A radial diffuser effects plating or coating of fluid entering the main body onto the interior walls thereof to increase heat transfer. A radial infuser receives collected fluid and directs the fluid into a containment chamber within the main body. A rotational turbulence inducer agitates the fluid as it exits the main body for increasing heat transfer between the fluid and the conduit, and induces the fluid at a positive relative pressure into the containment chamber. Alternative forms of the invention include a turbine mounted within the containment chamber for extracting rotational torque from movement of fluid through the device, and a lower main body having a pair of selectively valved radial infusers permitting reverse flow through the device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
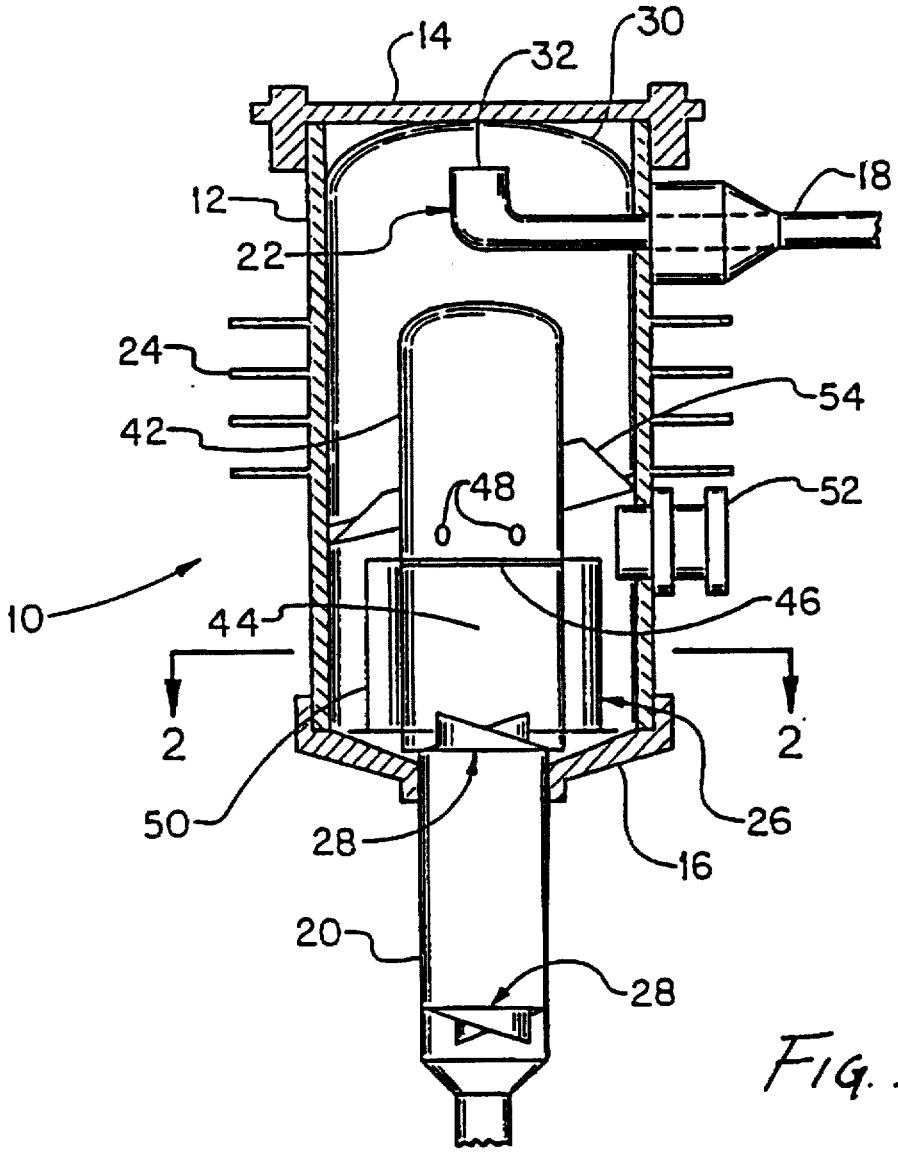
FIG. 1 is a cross sectional view of a fluid induction and heat exchange device according to the present invention.
Figure 2:
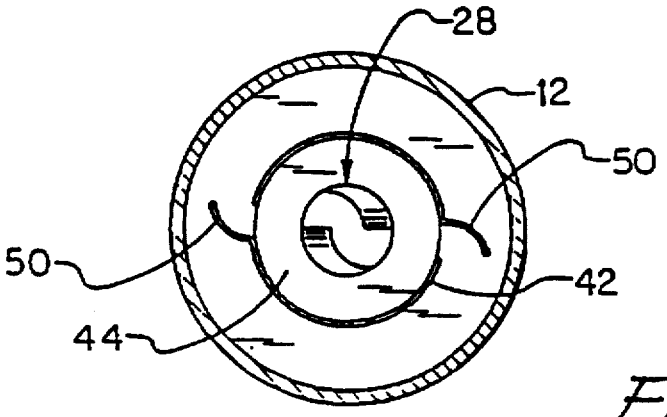
FIG. 2 is a cross sectional view thereof taken along line 2—2 of FIG. 1.

With reference now to the drawings, and in particular to FIGS. 1–16 thereof, a new fluid induction and heat exchange device embodying the principles and concepts of the present invention and generally designated by the reference numeral 10 will be described.

More specifically, it will be noted that the fluid induction and heat exchange device 10 comprises a main body 12 of any desired cross section, but preferably shaped in a cylindrical configuration. The main body 12 includes an upper end panel 14 and a lower end panel 16 which cooperate with an exterior side wall of the main body 12 so as to contain fluid within the device 10 as it travels therethrough. A first conduit 18 extends into the main body 12 and can be positioned into fluid communication with an unillustrated refrigerant line of a refrigerant or heat exchange system. A second conduit 20 extends from the main body 12 and is similarly positionable into fluid communication with a refrigerant or heat exchange system. A radial diffuser 22 is mounted within an upper portion of the main body 12 and in fluid communication with the first conduit 18 for directing fluid entering the main body radially outwardly so as to cause such fluid to coat or "plate" interior surfaces of the main body 12 to enhance heat transfer between the fluid and the main body. Fins 24 can extend from an exterior of the main body 12 so as to permit heat exchange between an exterior of the main body 12 and the surrounding ambient air. A radial infuser 26 can be mounted within the main body 12 proximal to the lower end panel 16 thereof for receiving collected fluid within a vortex containment chamber 44 positioned in fluid communication with the second conduit 20. One or more rotational turbulence inducers 28 are mounted within the second conduit 20 for inducing rotational turbulence within the fluid or refrigerant exiting from the main body 12. By this structure, increased efficiency of heat transfer between the fluid and the main body 12, as well as the second conduit, is attained. Further, the refrigerant or fluid traveling through the device 10 is consolidated within the vortex containment chamber 44 prior to exiting the main body 12 so as to eliminate or reduce suspended gas or vapor within the fluid or refrigerant. Thus, acting in either a positive pressure environment, a negative pressure environment, or at atmospheric pressure environment, the present invention 10 allows a refrigerant cycle or heat exchange system to operate at a greater efficiency by increasing heat transfer relative to the fluid or refrigerant, and decreasing an amount of suspended vapor or gas within the refrigerant.

As shown in FIG. 1, the radial diffuser 22 of the present invention 10 can comprise a concave dome member 30 mounted within the main body 12 proximal to the upper end panel 14 thereof. An upwardly directed elbow 32 can extend from within fluid communication with the first conduit 18 to a concentric position within the main body 12 so as to direct fluid entering the main body against the concave interior surface of the concave dome member 30. The concave dome member 30 extends into contiguous communication with interior surfaces of the main body 12 such that fluid directed onto the dome member 30 will be caused to flow radially outwardly against interior surfaces of the main body 12 so as to coat or plate such surfaces, thereby resulting in an increased heat transfer between the fluid and the main body 12. The coating or plating of the fluid or refrigerant on the interior surface of the main body 12 will be retained and supported as the fluid falls along the interior surface of the main body 12 by the inherent surface tension within the fluid.

Figure 3:
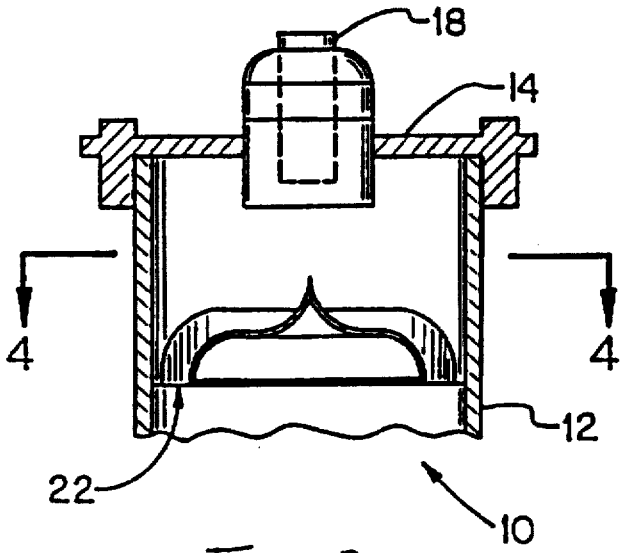
FIG. 3 is a cross sectional of a portion of the present invention including an alternative form of a radial diffuser thereof.
Figure 4:
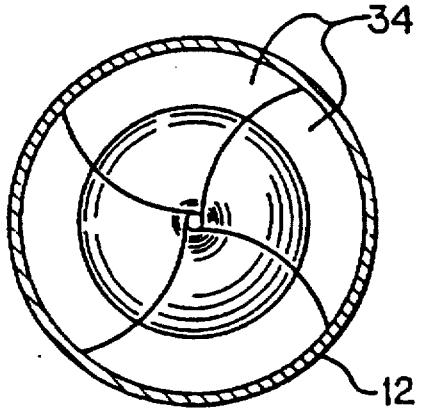
FIG. 4 is a cross sectional view taken along line 4—4 of FIG. 3.

A first alternative form of the radial diffuser 22 can be seen in FIGS. 3 and 4 and comprises directing the first conduit 18 through the upper end panel 14 of the main body 12 and into a center of the main body. A plurality of overlapping diffuser members 34 are mounted to interior surfaces of the main body 12 and extend radially inwardly therefrom to a center of the main body 12. The overlapping diffuser members 34 each extend along only a portion of an interior circumference or arc of the main body 12 and are spaced from one another at overlapping portions thereof such that fluid entering the first conduit 18 and impinging against the diffuser members 34 is caused to flow radially outwardly from a center of the main body 12 and between the spaced and overlapping diffuser members 34 onto interior surfaces of the main body 12. Preferably, the diffuser members 34 are each configured so as to impart at least a slight rotational motion to the fluid in either a clockwise or counter-clockwise direction as viewed from FIG. 4 of the drawings.

Figure 5:
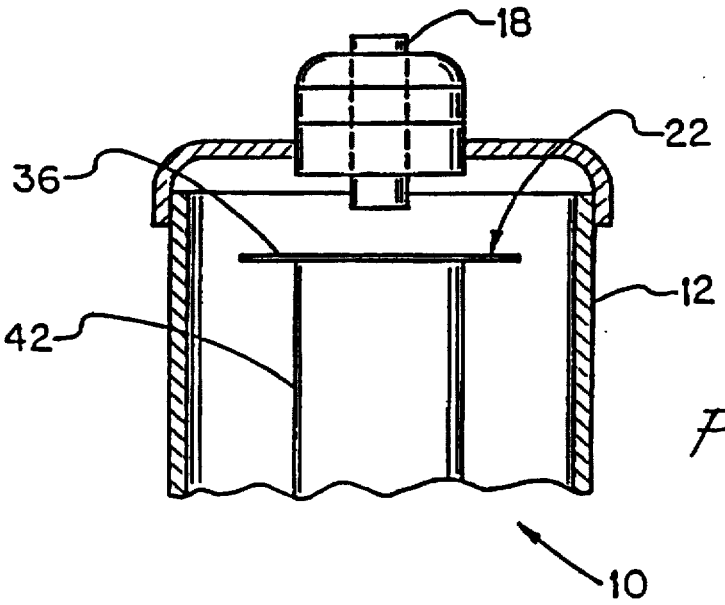
FIG. 5 is a cross sectional view of a portion of the present invention including a further alternative form of the radial diffuser.

A second alternative form of the radial diffuser 22 is shown in FIG. 5 and includes positioning the first conduit 18 through the upper end panel 14 of the main body 12 so as to direct fluid into a center of the main body 12. A diffusing member 36 in the form of a circular plate is concentrically mounted within the main body 12 and includes an outer peripheral edge spaced from interior surfaces of the main body 12 such that fluid impinging against the diffusing member 36 will be caused to flow radially outwardly against the interior surfaces of the main body 12 so as to coat the same and subsequently flow there along.

Figure 6:
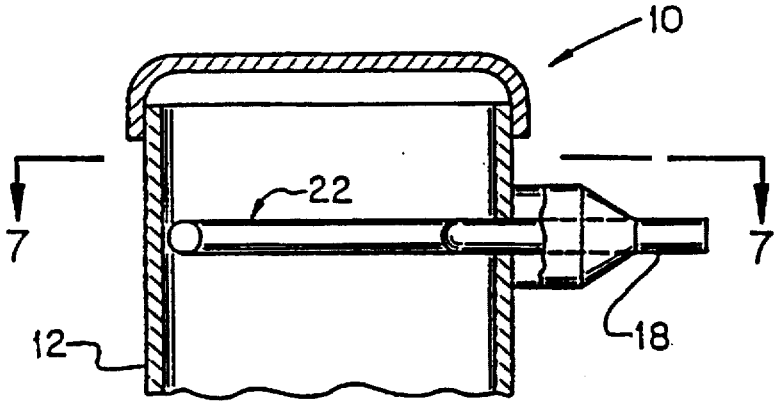
FIG. 6 is a cross sectional view of the invention including yet another alternative form of the radial diffuser.
Figure 7:
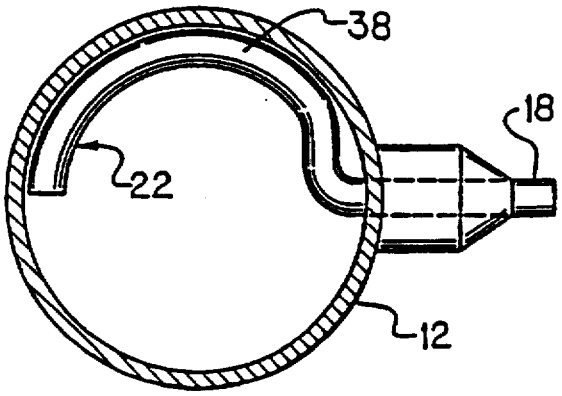
FIG. 7 is a cross sectional view taken along line 7—7 of FIG. 6.

A third alternative form of the radial diffuser 22 is shown in FIGS. 6 and 7 and includes directing the first conduit 18 through a side wall of the main body 12, with an arcuate interior conduit 38 extending from within fluid communication with the first conduit and in adjacency relative to an interior surface of the main body 12 for at least a portion of an inner arc thereof. By this structure, fluid entering the first conduit 18, and subsequently entering the arcuate interior conduit 38, is caused to impinge interior surfaces of the main body 12 and is further caused to rotate relative thereto into a helical pattern as gravity pulls the fluid towards the lower end panel 16 of the main body 12.

Figure 8:
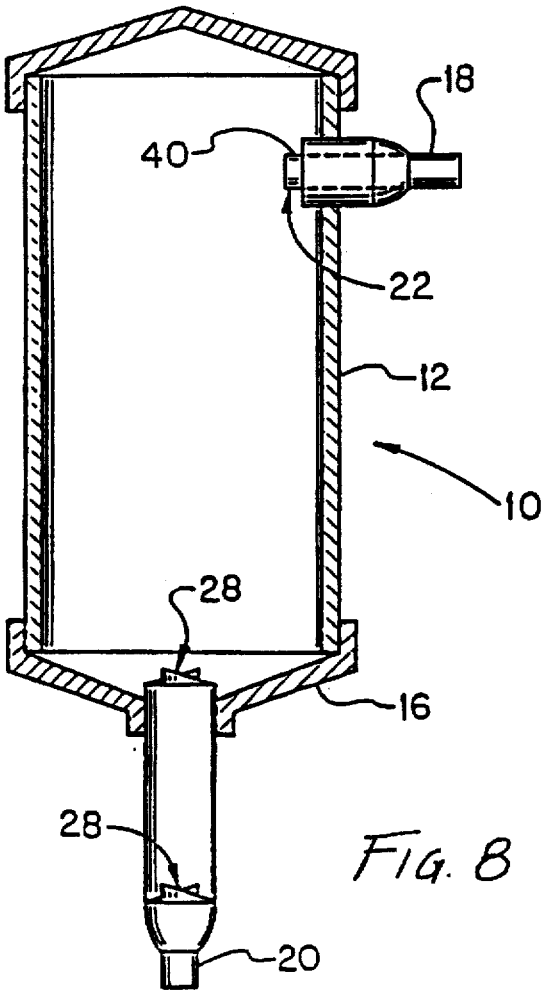
FIG. 8 is a cross sectional view of the invention including another further alternative form of the radial diffuser and illustrating construction of the present invention without a radial infuser of the invention being positioned within the main body thereof.

As shown in FIG. 8, the radial diffuser 22, in a fourth alternative form thereof, may simply comprise a straight interior conduit 40 extending from the first conduit 18 directed through a side wall of the main body 12 which simply causes fluid entering the device 10 to orthogonally impact an interior surface of the main body 12. In this alternative form of the present invention 10 illustrated in FIG. 8, it can be further shown that the present invention 10, in a more simple form thereof, may be constructed without the radial infuser 26 as shown in FIG. 1 of the drawings.

Referring back now to FIG. 1 of the drawings, it can be shown that the radial infuser 26 of the present invention 10 preferably comprises an elongated interior body 42 concentrically mounted within the main body 12 and positioned such that a lower end of the interior body 42 is positioned in fluid communication with the second conduit 20 projecting through the lower end panel 16 of the main body 12. The vortex containment chamber 44 of the radial infuser 26 is defined by an anti-cavitation plate 46 which extends diametrically across an interior of the interior body 42. Preferably, an upper end of the interior body 42 is closed and shaped so as to define an unlabeled domed surface which directs any impinging fluid radially outwardly therefrom towards interior surfaces of the main body 12. To reduce pressure within the upper enclosed end of the interior body 42, vent apertures 48 can be directed through an upper side wall portion of the interior body 42 above the anti-cavitation plate 46 to allow a flux of pressure within the upper portion of the interior body 42.

The radial infuser 26 further includes at least one radial fluid guide 50 extending from the interior body 42 proximal to an unlabeled aperture directed therethrough beneath the anti-cavitation plate 46. Preferably, the radial infuser 26 includes at least one pair of radial fluid guides 50 projecting from diametrically opposed exterior surfaces of the interior body 42 into a spaced position relative to an interior surface of the main body 12. Alternatively, the radial fluid guides 50 may extend into contact with an interior surface of the main body 12, if so desired. The radial fluid guides 50 operate to capture and direct fluid within the main body 12 radially inwardly at a positive relative pressure into the vortex containment chamber 44 for exiting through the second conduit 20. A sight glass 52 is preferably directed through a side wall of the main body 12 to allow refrigerant or fluid within the associated refrigerant or heat exchange system to be filled to a point resulting in a fluid level positioned at or slightly above the anti-cavitation plate 46. Thus, when the refrigeration or heat exchange system is fully charged, fluid or refrigerant within the main body 12 will cover the anti-cavitation plate 46 such that the radially inward direction of fluid into the vortex containment chamber 44 and downward direction of fluid through the second conduit 20 will not create a vortex in the fluid, as a full head of fluid is maintained within the vortex containment chamber 44 by the anti-cavitation plate 46 and the induced pressure generated at the radial fluid guides 50.

With continuing reference to FIG. 1, it can be shown that the radial infuser 26 may further comprise one or more semi-helical guide ramps 54 which are coupled to an exterior surface of the interior body 42 and extend radially outwardly therefrom to couple with an interior surface of the main body 12. The semi-helical guide ramps 54, only one of which is illustrated in FIG. 1 of the drawings, extend arcuately about the interior body 42 and downwardly in a helical fashion so as to capture fluid flowing downwardly along the interior surface of the main body 12 and impart a helical rotation thereto. Preferably, the guide ramps 54 each extend from a first position on the interior body 42 and downwardly therefrom to a second position at the interior surface of the main body 12, wherein the second position is located beneath the first position substantially as shown in FIG. 1 of the drawings. By such configuration of the semi-helical guide ramps 54, fluid falling vertically between the interior body 42 and the interior surface of the main body 12 is caused to impinge the guide ramp and flow radially outwardly from the interior body 42 against the interior surface of the main body 12, while simultaneously being caused to rotate about the interior body. Preferably, the semi-helical guide ramps 54 are positioned to slightly overlap one another so as to cause all fluid traveling vertically through the interior of the main body 12 to impinge at least a portion of at least one of the semi-helical guide ramps 54.

Figure 9:
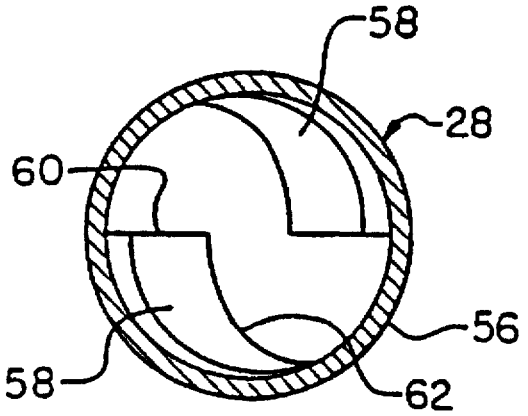
FIG. 9 is a top plan view of a rotational turbulence inducer of the present invention.
Figure 10:
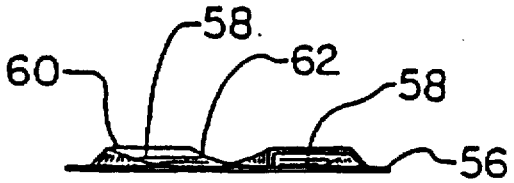
FIG. 10 is an elevation view of the rotation turbulence inducer.

Referring now to FIGS. 9 and 10 with concurrent reference to FIG. 1, it can be seen that the present invention 10 preferably includes a pair of rotational turbulence inducers 28 positioned in corresponding rotational orientations or directions and spaced from one another within an enlarged portion of the second conduit 20 proximal to the lower end panel 16 of the main body 12. Each of the rotational turbulence inducers 28 preferably comprises an annular member 56 which may or may not be part of the second conduit 20 or lower end panel 16 or interior body 42. A pair of rotational ramps 58 extend from diametrically opposed sides of the annular member 56 and each include an unlabeled arcuate interior connecting panel extending inwardly from an interior surface of the annular member 56 to couple with an unlabeled inner arcuate edge of the respective rotational ramp 58. A linear edge 60 of each of the ramps 58 extends radially inwardly towards a center of the annular member 56 from an intersection of the arcuate interior connecting panel and the respective rotational ramp 58. The rotational ramps 58 are each shaped so as to define an outer arcuate edge 62, as shown labeled for one of the rotational ramps in FIG. 9, which extends arcuately from an interior end of the linear edge 60 and curves into contiguous communication with the annular member 56. As shown in FIG. 10, the linear edge 60 of each of the rotational ramps 58 resides within a plane spaced from a plane containing the annular member 56 such that the arcuate edge 62 of each rotational ramp 58 arcuately and angularly extends from the linear edge 60 to the interior surface of the annular member 56. Further, each of the rotational ramps 58 may additionally include an unlabeled arcuate interior connecting panel extending substantially orthogonally downwardly from the outer arcuate edge 62 of the respective rotational ramp 58 so as to reduce pressure-induced laterally directed fluid communication from an upper surface of the respective ramp about the outer arcuate edge 62 thereof to beyond the lower surface of the ramp. By this structure, fluid traveling axially through the annular member 56 is subjected to a rapid relative high/low pressure gradient while it is agitated into a state of turbulent flow and further caused to rotate in a clockwise or counter clockwise direction depending upon an orientation of the rotational ramps 58 within the second conduit 20.

Figure 11:
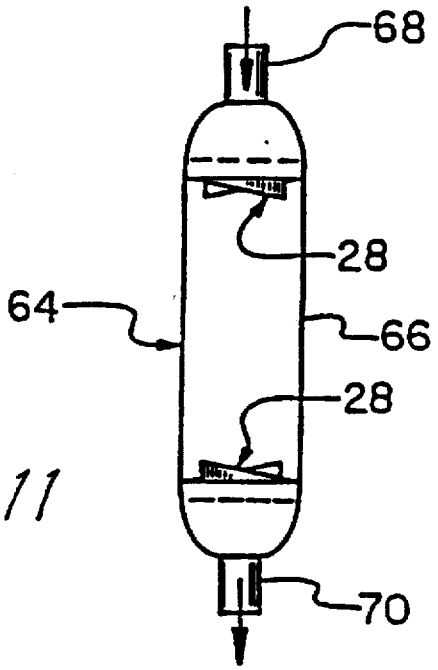
FIG. 11 is an elevation view of an in-line turbulence inducer assembly for use with the present invention.

As shown in FIG. 11, the present invention 10 may take the form of an in-line turbulence inducer assembly 64 including an inducer assembly body 66 having a first port 68 and a second port 70 positionable in-line with either conduit 18 or 20 of the present invention 10, or alternatively positionable, per se, in-line with a portion of the refrigerant or heat exchange system. The in-line turbulence inducer assembly 64 includes one or more rotational turbulence inducers 28 positioned therein which cooperate to agitate and rotate fluid traveling through the inducer assembly 64. Preferably, the inducer assembly 64 includes a pair of spaced and oppositely oriented rotational turbulence inducer 28, as shown in FIG. 11, which are oriented so as to impart rotation to fluid traveling from the first port 68 through the inducer assembly body 66 towards the second port 70 into corresponding directions. By this structure, the in-line turbulence inducer assembly 64 can be utilized in combination with the present invention or by itself to effect increased turbulence and/or heat exchange of the fluid or refrigerant of the system.

Figure 12:
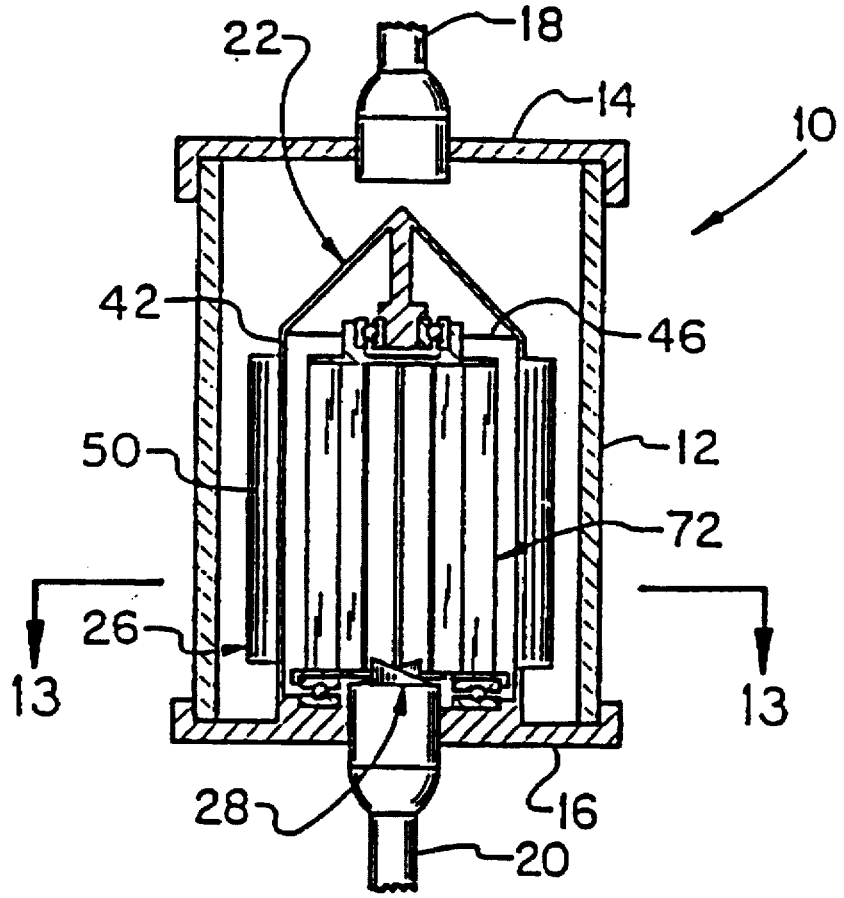
FIG. 12 is a cross sectional view of an alternative form of the present invention including a turbine.
Figure 13:
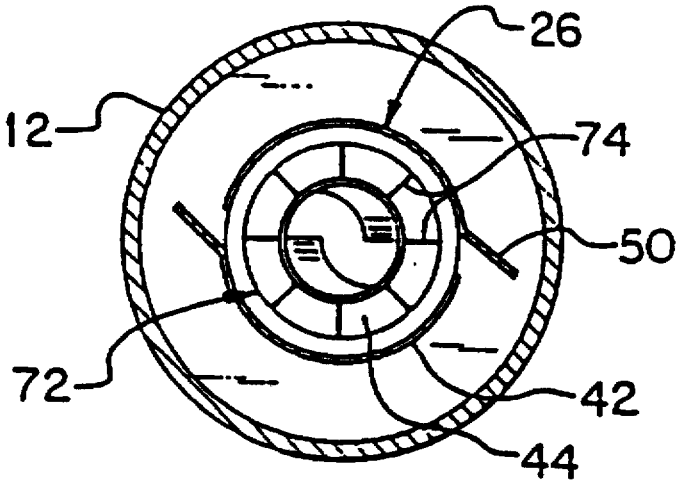
FIG. 13 is cross sectional view taken along line 13—13 of FIG. 12.

Referring now to FIGS. 12 and 13 wherein an alternative form of the present invention 10 is illustrated in detail, it can be shown that the alternative form of the fluid induction and heat exchange device 10 can include a turbine 72 rotatably mounted within the interior body 42 of the radial infuser 26 between the anti-cavitation plate 46 and the lower end panel 16 of the main body 12. The turbine 72 is supported there within upon unlabeled bearings which cooperate to support the turbine in both radial and axial directions. Although not specifically illustrated, a shaft can be mechanically coupled to the turbine 72 and extended through the main body 12 to extract rotational torque from the alternative form of the present invention 10. As shown in FIG. 13, the radial fluid guides 50 of the radial infuser 26 are configured to direct fluid into the vortex containment chamber 44 wherein the turbine 72 is mounted such that the fluid is projected in opposite directions on diametrically opposed sides of a center rotational axis of the turbine 72 so as to cause rotation thereof as fluid enters the vortex containment chamber 44 prior to exiting of the device 10 through the second conduit 20. To this end, the turbine 72 comprises at least one pair of unlabeled spaced plates, with a lower plate thereof having an aperture directed therethrough positioned in fluid communication with the second conduit 20. A plurality of blades 74 extend vertically between the spaced plates of the turbine 72 and operate to receive fluid entering the vortex containment chamber 44 so as to impart rotation to the turbine 72. By this structure, the alternative form of the present invention 10 illustrated in FIGS. 12 and 13 can be utilized as a heat exchange device, a fluid motor, or both.

Figure 14:
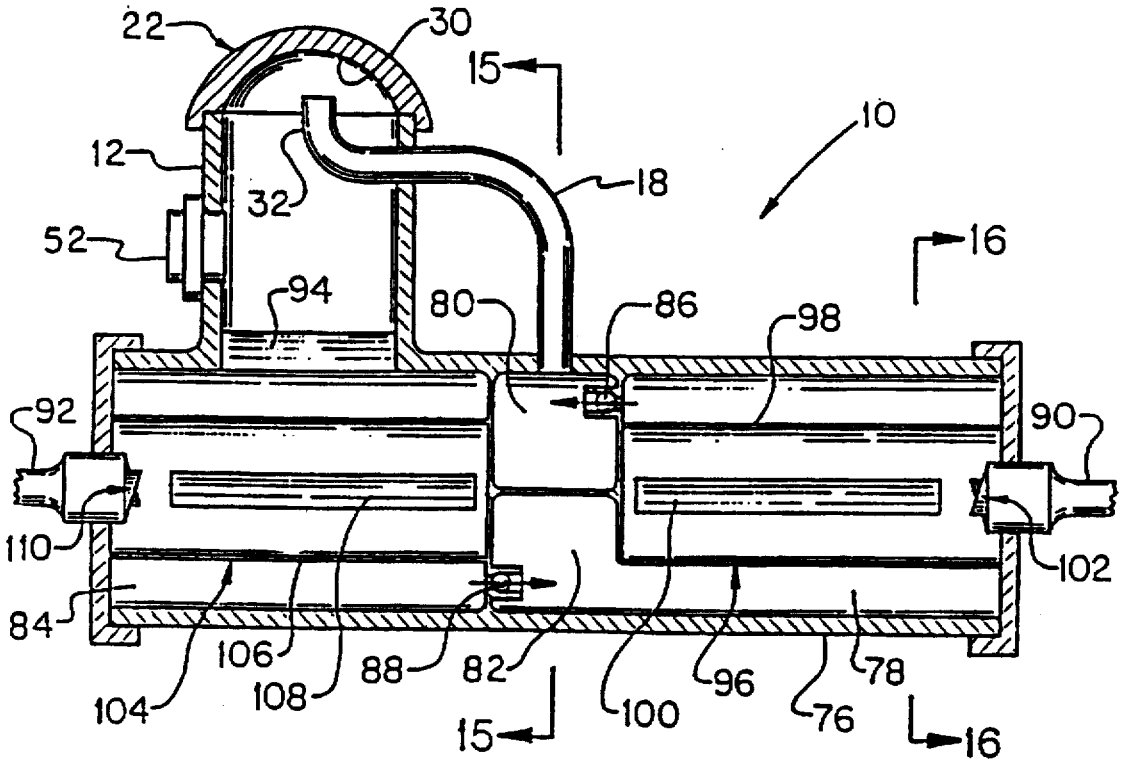
FIG. 14 is a cross sectional view of a further alternative form of the present invention including a lower main body having a pair of selectively valved radial infusers.
Figure 15:
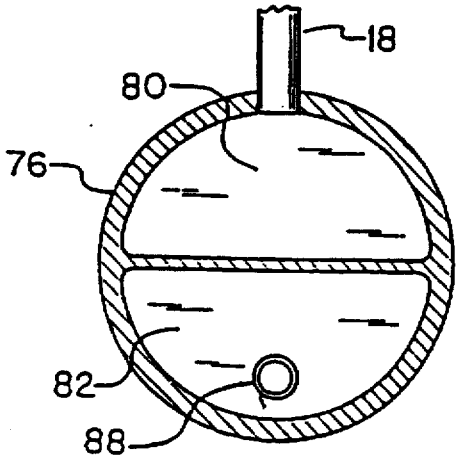
FIG. 15 is a cross sectional view taken along line 15—15 of FIG. 14.
Figure 16:
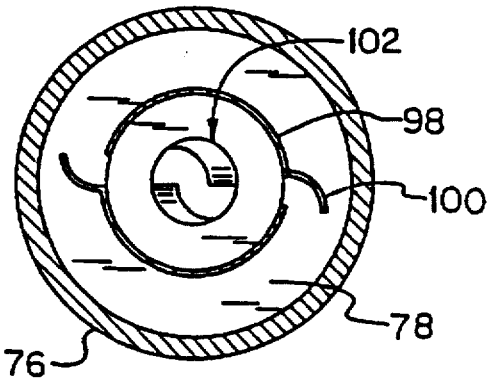
FIG. 16 is a cross sectional view taken along line 16—16 of FIG. 14.

Referring now to FIGS. 14 through 16 wherein a further alternative form of the present invention 10 is illustrated, it can be shown that the present invention may be configured to accommodate fluid flow therethrough in both forward and reverse directions for use within a reversible heat pump system. To this end, the further alternative form of the present invention 10 further comprises a lower main body 76 mounted relative to the main body 12 and having unlabeled divider panels extending therethrough separating an interior of the lower main body 76 into a right chamber 78, an upper center chamber 80, a lower center chamber 82, and a left chamber 84. The lower center chamber 82 is positioned in fluid communication with the right chamber 78 such that fluid entering the lower center chamber 82 will flow into the right chamber 78. At least one upper center chamber 80 is positioned in fluid communication with the first conduit 18 entering the main body 12. An upper check valve 86 extends from the right chamber 78 into the upper center chamber 80 and allows fluid flow only from the right chamber 78 into the upper center chamber 80. A lower check valve 88 extends from the left chamber 84 into the lower center chamber 82 and allows fluid flow only from the left chamber 84 to the lower center chamber 82. A right conduit 90 extends through a right end panel of the lower main body 76 and into fluid communication with the right chamber 78 thereof. Similarly, a left conduit 92 extends through a left end panel of the lower main body 76 and into fluid communication with the left chamber 84 thereof. The main body 12 extends into fluid communication with the left chamber 84 of the lower main body 76 in this further alternative form of the present invention 10 and includes an angled drop ramp 94 extending therebetween which directs fluid into a radially offset orientation relative to a center of the left chamber 84 so as to cause fluid exiting the main body 12 to rotatingly enter the left chamber 84.

The further alternative form of the present invention 10 shown in FIGS. 14 through 16 additionally includes a right radial infuser 96 extending within the right chamber 78 which comprises a right interior body 98 concentrically positioned within the right chamber 78 of the lower main body 76 and including at least one, and a preferably a pair of oppositely directed right radial fluid guides 100 projecting therefrom. A right rotational turbulence inducer 102 can be positioned into fluid communication with the right conduit 90 so as to induce turbulence within fluid flowing through the further alternative form of the device 10. Similarly, the left chamber 84 desirably includes a left radial infuser 104 mounted therein which comprises a left interior body 106 extending concentrically through the left chamber 84 of the lower main body 76 having at least one, and preferably a pair of left radial fluid guides 108 projecting therefrom. Further, a left rotational turbulence inducer 110 can be mounted in fluid communication with the left conduit 92.

As shown in FIG. 14, during operation of the device fluid will flow through the right conduit 90 of the further alternative form of the present invention 10 and will initially be agitated by the right rotational turbulence 102. The fluid will then flow in a reverse direction through the right radial infuser 96 relative to the described direction of fluid flow through the right radial infuser 96 of the invention as illustrated in FIG. 1 and into an outer portion of the right chamber 78. The fluid will then be allowed to pass through the upper check valve 86 into the upper center chamber 80 for transfer into the main body 12 through the first conduit 18. The radial diffuser 22 will deflect the fluid radially outwardly to coat or plate an interior surface of the main body 12 to a level possibly defined by the sight glass 52 extending through the main body 12. The condensed and consolidated fluid will then flow through the angled drop ramp 94 and into the left chamber 84 of the lower main body 76, whereby rotation of the fluid within the left chamber is induced by the configuration of the angled drop ramp 94 directing the fluid into the left chamber 84 in an offset orientation relative to a center axis thereof. The left radial fluid guides 108 then capture and direct the fluid radially inwardly into an unlabeled vortex containment chamber of the left radial infuser 104 for exiting through the left rotational turbulence inducer 110 and ultimately the left conduit 92.

When a flow of fluid through the alternative form of the device 10 as illustrated in FIG. 14 is reversed, fluid will initially enter the left chamber 84 and pass through the lower check valve 88 into the lower center chamber 82 and subsequently into the right chamber 78, thereby completely avoiding the path of fluid flow through the main body 12 and first conduit 18. The fluid then flowing into the right chamber 78 from the lower center chamber 82 will be deflected radially inwardly by the right radial infuser 96 for exiting through the right rotational turbulence inducer 102 and right conduit 90. This alternative form of the present invention 10 illustrated in FIG. 14 can be utilized in the positioning illustrated in FIG. 14 wherein a longitudinal axis of the lower main body 76 extends parallel to a horizontal axis. However, it should be noted that under a normal operating pressure of approximately two-hundred and ninety P.S.I., the further alternative form of the present invention 10 is believed to be useful in a vertical positioning as well.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is follows:

1. A device positionable in a fluid line, said device comprising:

a main body including at least one exterior side wall, a first end panel and a second end panel;

a first inflow conduit entering into the main body wherein the first inflow conduit is in fluid communication with the inflow fluid line;

a second outflow conduit extending from the main body wherein the second outflow conduit is in fluid communication with the outflow fluid line;

rotational inducer means for causing fluid within the main body to rotate, relative to a side wall thereof, into a helical pattern as the fluid moves through the main body toward the second end panel thereof;

radial infuser means positioned within the main body proximal to the second end panel thereof, the radial infuser means comprising an interior body positioned within the main body wherein the interior body comprises at least one exterior side wall, an end cap, and at least one inner containment chamber positioned in fluid communication with the second outflow conduit, and further wherein the interior body has a smaller interior radius than does the main body, and still further wherein the interior body comprises means for collecting the rotating fluid from the main body and consolidating the rotating fluid within the inner containment chamber wherein the rotating fluid is contained and wherein a decrease in the radius of rotation within the inner containment chamber causes an amplification of the velocity of the rotating fluid prior to the time the fluid exits the device.

2. The device of claim 1, wherein the main body is substantially circular in diameter, in cross section.

3. The device of claim 1, wherein the rotational inducer means comprise a concave dome member positioned within the main body proximal to a first end panel thereof; and an upwardly directed elbow extending from within fluid communication with the first inflow conduit to a position within the main body so as to direct fluid entering the main body against a concave interior surface of the concave dome member, wherein the concave dome member extends into contiguous communication with interior surfaces of the main body such that fluid directed onto the dome member will be caused to flow radially outwardly against interior surfaces of the main body, and to rotate, relative to a side wall of the main body, into a helical pattern as the fluid moves through the main body toward the second end panel thereof.

4. The device of claim 1, wherein the rotational inducer comprises the first inflow conduit directed into the main body proximal to the first end panel thereof, and oriented to project towards the second end panel thereof, and wherein the rotational inducer further comprises a circular plate concentrically positioned within the main body and including an outer peripheral edge spaced from interior surfaces of the main body such that fluid impinging against the circular plate will be caused to flow radially outwardly against the interior surfaces of the main body, and to rotate, relative to a side wall of the main body, into a helical pattern as the fluid moves through the main body toward the second end panel thereof.

5. The device of claim 1, wherein the rotational inducer comprises an arcuate interior conduit extending from within fluid communication with the first inflow conduit and in adjacency relative to an interior surface of the main body for at least a portion of an inner arc thereof, whereby fluid entering the arcuate interior conduit through the first inflow conduit is caused to impinge interior surfaces of the main body and is further caused to rotate relative thereto.

6. The device of claim 1, wherein the rotational inducer comprises a straight interior conduit extending from fluid communication with the first inflow conduit, the straight interior conduit being directed so as to extend at an orthogonal orientation relative to an interior surface of the main body.

7. The device of claim 1, wherein the rotational inducer comprises at least one substantially circular plate supported substantially concentrically within the main body beneath the first inflow conduit, wherein the circular plate(s) include an outer peripheral edge spaced from interior surfaces of the main body such that fluid impinging against the circular plate(s) will be caused to flow radially outwardly against the interior surfaces of the main body, and to rotate, relative to a side wall of the main body, into a helical pattern as the fluid moves through the main body toward the second end panel thereof.

8. The device of claim 1, wherein the rotational inducer comprises a domed shaped end cap on the interior body, wherein fluid impinging against the domed surface will be caused to flow radially outwardly against the interior surfaces of the main body, and to rotate, relative to a side wall of the main body, into a helical pattern as the fluid moves through the main body toward the second end panel thereof.

9. The device of claim 1 wherein the rotational inducer means further comprise two or more fluid flow guides extending radially inwardly proximal to a center of the main body and configured to overlap one another in a spaced relationship, the overlapping fluid flow guides each extending along only a portion of an interior circumference arc of the main body and being spaced from one another at overlapping portions thereof such that fluid entering the main body through the first inflow conduit and impinging against one of the fluid flow guides is caused to flow radially outwardly from a center of the main body and between the spaced and overlapping fluid flow guides onto interior surfaces of the main body, and to rotate, relative to a side wall of the main body, into a helical pattern as the fluid moves through the main body toward the second end panel thereof.

10. The device of claim 1 wherein the rotational inducer means further comprise at least one semi-helical guide ramp coupled relative to an exterior surface of the interior body and extending radially outwardly therefrom towards an interior surface of the main body.

11. The device of claim 10 wherein the semi-helical guide ramp is coupled to an interior surface of the main body and extends arcuately about the interior body and downwardly in a helical fashion so as to capture fluid flowing downwardly along the interior surface of the main body and impart a helical rotation thereto.

12. The device of claim 11, wherein the guide ramp is coupled to an exterior surface of the interior body and extends from a first position on the interior body and downwardly therefrom to a second position at the interior surface of the main body, wherein the second position is located beneath the first position so as to cause a radially outwardly directed flow of fluid to the interior surface of the main body.

13. The device of claim 1, wherein the interior body of the radial infuser means comprises an elongated body substantially concentrically positioned within the main body, further wherein the interior body has at least one aperture directed therethrough allowing fluid communication between the interior of the main body and the inner containment chamber, and still further wherein the radial infuser directs fluid rotating within the main body radially inwardly into the inner containment chamber wherein a decrease in the radius of rotation within the inner containment chamber causes an amplification of the velocity of the rotating fluid prior to the time the fluid exits the device.

14. The device of claim 13, wherein the radial infuser comprises at least one radial fluid directional guide extending from the interior body proximal to an aperture directed therethrough so as to capture and direct fluid rotating within the main body radially inwardly into the inner containment chamber wherein a decrease in the radius of rotation within the inner containment chamber causes an amplification of the velocity of the rotating fluid prior to the time the fluid exits the device.

15. The device of claim 1, and further comprising a turbine rotatably positioned within the interior body of the radial infuser, the radial fluid guide of the radial infuser being configured to direct fluid towards the turbine in opposite directions on diametrically opposed sides of a center rotational axis of the turbine so as to cause rotation thereof.

16. The device of claim 1, wherein at least one heat transfer fin extends from an exterior of the main body so as to permit heat exchange between an exterior of the main body and a transfer medium.

17. A device positionable in a fluid line, said device comprising:

a main body including at least one exterior side wall, a first end panel and a second end panel;

a first inflow conduit entering into the main body wherein the first inflow conduit is in fluid communication with the inflow fluid line;

a second outflow conduit extending from the main body wherein the second outflow conduit is in fluid communication with the outflow fluid line;

rotational inducer means for causing fluid within the main body to rotate, relative to a side wall thereof, into a helical pattern as the fluid moves through the main body toward the second end panel thereof;

radial infuser means positioned within the main body proximal to the second end panel thereof, the radial infuser means comprising an interior body positioned within the main body wherein the interior body comprises at least one exterior side wall, an end cap, a first inner containment chamber and a second inner containment chamber wherein the first inner containment chamber is positioned in fluid communication with the second inner containment chamber, which is positioned in fluid communication with the second outflow conduit, and further wherein the first inner containment chamber has a smaller interior radius than does the main body and the second inner containment chamber has a smaller interior radius than does the first inner containment chamber, and still further wherein the interior body comprises means for collecting the rotating fluid from the main body and consolidating the rotating fluid within the first inner containment chamber wherein a decrease in the radius of rotation within the first inner containment chamber causes an amplification of the velocity of the rotating fluid within the first inner containment chamber prior to the time the fluid enters the second inner containment chamber, where again a decrease in the radius of rotation within the second inner containment chamber causes an amplification of the velocity of the rotating fluid within the second containment chamber prior to the time the fluid exits the device.

18. The device of claim 17, wherein at least one heat transfer fin extends from an exterior of the main body so as to permit heat exchange between an exterior of the main body and a transfer medium.

19. A device positionable in a refrigerant liquid line, said device comprising:

a main body that is substantially circular in diameter, in cross section, and including an upper end panel and a lower end panel;

a first inflow conduit entering into the main body wherein the first inflow conduit is in liquid communication with the inflow refrigerant liquid line;

a second outflow conduit extending from the main body wherein the second outflow conduit is in liquid communication with the outflow refrigerant liquid line;

rotational inducer means for causing liquid refrigerant within the main body to rotate, relative to the side wall thereof, into a helical pattern as the liquid refrigerant moves through the main body toward the lower end panel thereof;

radial infuser means positioned within the main body proximal to the lower end panel thereof, the radial infuser means comprising an interior body positioned within the main body wherein the interior body is substantially circular in diameter, in cross section, and comprises an exterior side wall, an end cap, and an inner containment chamber positioned in liquid communication with the second outflow conduit, and further wherein the interior body has a smaller interior radius than does the main body, and still further wherein the interior body comprises means for collecting the rotating liquid refrigerant from the main body and consolidating the rotating liquid refrigerant within the inner containment chamber wherein the rotating liquid refrigerant is contained and wherein a decrease in the radius of rotation within the inner containment chamber causes an amplification of the velocity of the rotating liquid refrigerant prior to the time the liquid refrigerant exits the device.

20. The device of claim 19, wherein at least one heat transfer fin extends from an exterior of the main body so as to permit heat exchange between an exterior of the main body a transfer medium.

21. A device positionable in a gas line, said device comprising:

a main body including at least one exterior side wall, a first end panel and a second end panel;

a first inflow conduit entering into the main body wherein the first inflow conduit is in vapor communication with the inflow gas line;

a second outflow conduit extending from the main body wherein the second outflow conduit is in vapor communication with the outflow gas line;

rotational inducer means for causing gas within the main body to rotate, relative to a side wall thereof, into a helical pattern as the gas moves through the main body toward the second end panel thereof;

radial infuser means positioned within the main body proximal to the second end panel thereof, the radial infuser means comprising an interior body positioned within the main body wherein the interior body comprises at least one exterior side wall, an end cap, and at least one inner containment chamber positioned in vapor communication with the second outflow conduit, and further wherein the interior body has a smaller interior radius than does the main body, and still further wherein the interior body comprises means for collecting the rotating gas from the main body and consolidating the rotating gas within the inner containment chamber wherein the rotating fluid is contained and wherein a decrease in the radius of rotation within the inner containment chamber causes an amplification of the velocity of the rotating gas prior to the time the gas exits the device.

22. The device of claim 21, wherein at least one heat transfer fin extends from an exterior of the main body so as to permit heat exchange between an exterior of the main body and a transfer medium.

23. The device of claim 1 further comprising a turbine, wherein the turbine comprises at least one pair of spaced plates, with a lower plate thereof having an aperture directed therethrough positioned in fluid communication with the second outflow conduit; and a plurality of blades extending vertically between the spaced plates of the turbine and positioned for receiving fluid entering the chamber to impart rotation to the turbine.

* * * * *